United States Patent [19]

Corder

[11] 4,205,817

[45] Jun. 3, 1980

[54] MUSIC HOLDER

[76] Inventor: James T. Corder, 2403 Gladstone Dr., Huntsville, Ala. 35811

[21] Appl. No.: 910,194

[22] Filed: May 30, 1978

[51] Int. Cl.[2] ..... G10G 5/00

[52] U.S. Cl. ..... 248/443; 248/441 A

[58] Field of Search ..... 248/441 A, 443, 451, 248/453; 211/50

[56] References Cited

U.S. PATENT DOCUMENTS

| | | | |
|---|---|---|---|
| 760,299 | 5/1904 | Belding | 211/50 X |
| 764,121 | 7/1904 | Guilford | 211/50 X |
| 1,070,239 | 8/1913 | Ferguson | 211/50 |
| 2,234,086 | 3/1941 | Rosebaugh | 248/443 |
| 2,514,068 | 7/1950 | Johnston | 248/443 |
| 2,832,172 | 4/1958 | Shelf | 248/443 |
| 2,915,849 | 12/1959 | Johnston | 248/443 |
| 3,176,953 | 4/1965 | Magers | 248/451 |
| 3,536,289 | 10/1970 | Johnston | 248/443 |

*Primary Examiner*—Wiliam H. Schultz
*Attorney, Agent, or Firm*—C. A. Phillips

[57] ABSTRACT

A music holder of the type which is adapted to be held by a lyre, in turn supported on a musical instrument. It employs a generally rigid plate having a pair of side positioned U-shaped brackets which enable transparent, music holding envelopes hingedly attached to the top of the plate to be secured on the sides to the plate.

4 Claims, 7 Drawing Figures

MUSIC HOLDER

BACKGROUND OF THE INVENTION

1. Field of the Invention

This invention relates to a music holder of the type adapted to be mounted on a lyre, in turn mounted on a musical instrument.

2. General Description of the Prior Art

U.S. Pat. No. 3,536,289 discloses a music holder of the general type involved in the present invention. As shown in this patent, there is employed a plurality of clear plastic envelopes which are hingedly supported at the top of a rectangular music holder, and music is inserted in the envelopes through side openings in the envelopes. This patent deals with the problem of preventing wind from blowing through and between the sheets and causing music to be lost or moved out of position and features vertically positioned side walls which block wind and the employment of rubber bands which fit laterally around the sheets and are are held in position in grooves in the side walls.

As stated above, the music holder is itself rectangular, and because of this and the rather close positioning of rubber bands around the music, it has been found extremely difficult to move an envelope from the front (facing) side to the opposite side of the holder as necessary to view different pieces of music. This is particularly so when one has to perform the operation with one hand, which is normally the case since the user has to hold his musical instrument with the other hand.

Accordingly, it is an object of the present invention to overcome the difficulties experienced with previous related devices, and to provide an improved music holder where music is sufficiently securely held so as not to become deteached from the holder, and yet pieces of music can be readily moved from the front to the back, or vice versa, of the music holder by one hand.

SUMMARY OF THE INVENTION

In accordance with this invention, instead of the use of side walls to shield wind from blowing through and between envelopes of music held by a music holder, a pair of U-shaped brackets are attached to and around opposite side edges of the music holder and face each other. Thus, there is provided holding recesses on the back and front of the holder which effectively prevent the envelopes from blowing upward out of view.

As a further feature of the invention, the bottom corners of the holders are cut away, thus departing from a rectangular configuration, enabling one to readily grip corners of the envelopes and thus easily maneuver them.

As a still further feature of the invention, slots are cut in the bottom of the holder to receive the clamping mechanism of the lyre with which the holder is used, thus enabling the holder to set down further into the lyre and provide an enhanced stability in the gripping of the music holder by the lyre.

As a still further feature of the invention, the envelopes are top loaded rather than side loaded, and the sides of the envelopes are closed. Thus, there is no opportunity for wind to blow through the envelopes to dislodge music.

Finally, the need for rubber bands is completely eliminated.

FIGS. *6a* and *6b* illustrate a second alternate form of a U-shaped bracket for use in retaining music on the music holder.

DETAILED DESCRIPTION OF THE DRAWINGS

Figure 1:
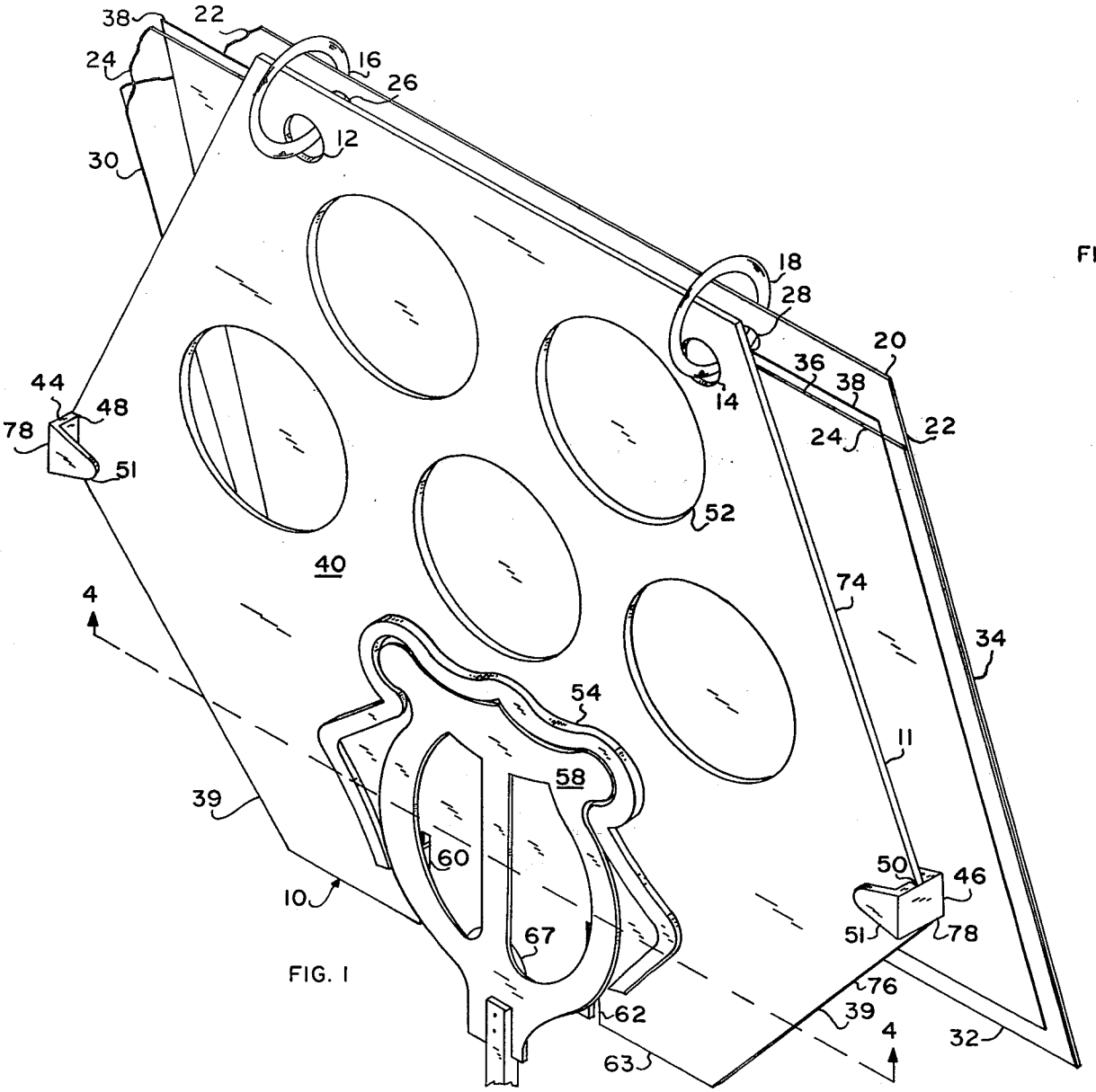
FIG. 1 is a pictorial view of a music holder embodying the principles of this invention and illustrates its use wherein it is held by a lyre. The back side of the lyre is illustrated in engagement with the music holder.
Figure 2:
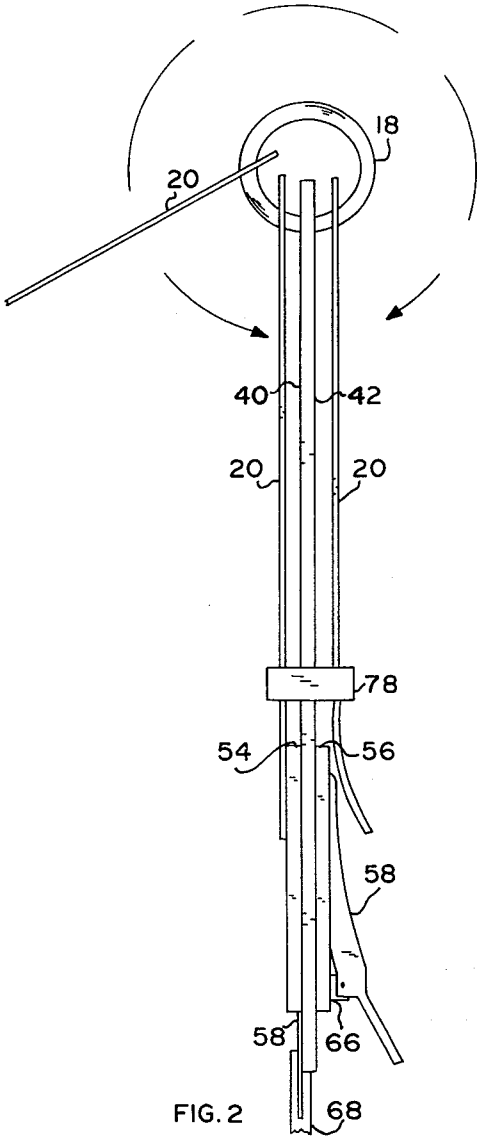
FIG. 2 is a side elevational view of a music holder.

Referring initially to FIG. 1, music holder 10 is basically constructed of a thin (1/16 to 3/32 inch) sheet or plate 11 of ABS and typically formed by injection molding. A pair of openings 12 and 14 positioned oppositely in the top region of plate 11 mounts rings 16 and 18, which support music holding envelopes 20. Typically, there would be accommodated four to six such envelopes, as shown in FIG. 2. As a feature of this invention, the envelopes are formed of transparent plastic sheets 22 and 24, with sheet 22 having upper openings 26 and 28 which accept rings 16 and 18. Sheet 24 is attached to sheet 22 along edges 30, 32, and 34, with upper edge 36 terminating slightly below openings 26 and 28 and being unattached, thus enabling a music sheet 38 to be inserted and held between sheets 22 and 24. As shown in FIG. 1, music sheet 38 is being viewed through sheet 24. Instead of being purely rectangular, diagonally cut corner regions 39 are made across the otherwise four corners of holder 10. In addition to making the device lighter, this configuration enables easy gripping of any one of the four corner regions of envelopes 20, enabling them to be readily moved from one side or face 40 (FIG. 2) of plate 11 to the other side 42.

Figure 4:
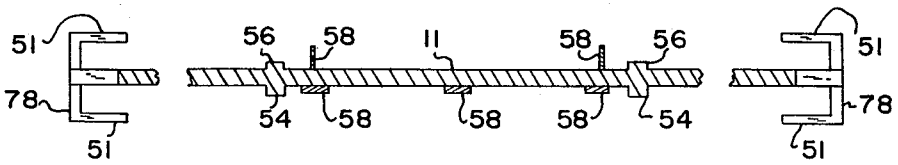
FIG. 4 is a sectional view taken along lines 4—4 of FIG. 1.

Significantly, and in accordance with another and principal feature of this invention, U-shaped brackets 44 and 46, typically of the same material as plate 11, are oppositely positioned and attached to plate 11 in indented regions 48 and 50, respectively. Identical arms or fingers 51 of the "U" extend equally on opposite sides of plate 11 (FIG. 4). Typically, the brackets would be glued in place. As thus arranged, and as shown in FIG. 2, envelopes 20 are retained in a vertical position by these brackets.

Relatively large openings 52 are simply employed to lighten plate 11 and to save material. Brackets 44 and 46 can readily be made from the material otherwise used in one of the cut-out regions, such as the corner diagonal cut-outs or one of openings 52.

Figure 3:
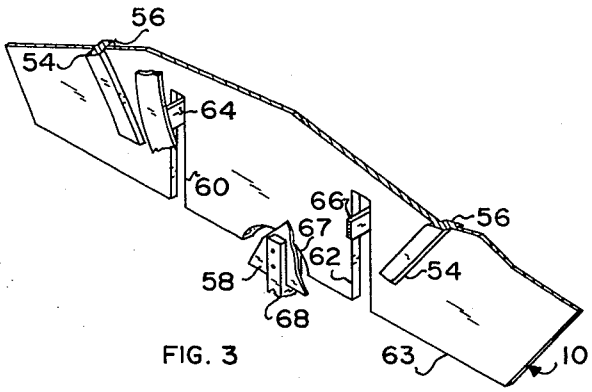
FIG. 3 is a partial pictorial view with principal parts of the music holder and lyre broken away to particularly illustrate certain points of engagement between the lyre and music holder.

Opposite sides or faces 40 and 42 of plate 11 have identically raised surface regions 54 and 56 which are configured to fit around lyre 58, and thus to provide a partial locking of the lyre to holder 10. Additionally, and as a feature of the invention, a pair of slots 60 and 62 are cut into the bottom edge 63 of holder 10 and extend upward for approximately ½ inch to accept lyre members 64 and 66 (FIG. 3). Semi-circular opening 67 is cut into edge 63 between slots 60 and 62 to provide clearance for support member 68 of lyre 58. By the combinaton of raised regions 54 and 56 and slots 60 and 62, means are provided to effect a substantially improved stability of fastening between lyre 58 and holder 10.

Figure 5:
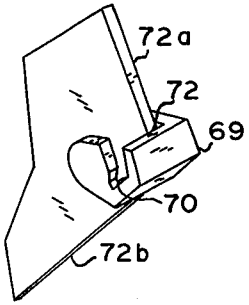
FIG. 5 illustrates a pictorial view of an alternate form of a U-shaped bracket used in retaining music on the music holder.

FIG. 5 illustrates a modified form for the brackets wherein a bracket 69 has an interior triangular surface 70 by which one of them simply fits over a corner region 72 of holder 10 where straight side edges 72*a* and 72*b* intersect. This is possible since the interior surface of the brackets need not be of any particular size or configuration, and in this case they simply follow the angle of the cut-out surface of holder 10 rather than having a plain or a straight surface as shown for the embodiment of FIG. 1.

Figure 6A:
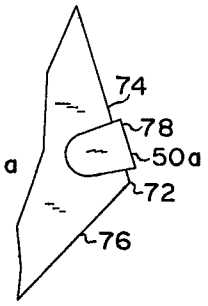
Figure 6B:
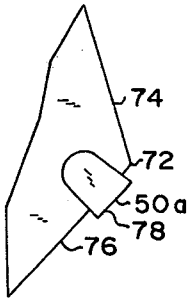

FIGS. 6*a* and 6*b* illustrate other arrangements for the brackets wherein brackets like those of FIG. 1 are employed and mounted on the side of a corner where diagonal side edges 74 and 72 of plate 11*a* join. Thus, as shown in FIG. 6*a*, bracket 50*a* would be mounted on edge 74, and in FIG. 6*b*, it is shown as mounted on edge 76. A like arrangement of mounting would be made on an opposite edge of the plate of the music holder. Still alternately, but not shown, a wire or perhaps spring form of a bracket having the same general configuration as shown in FIGS. 1, 6*a*, and 6*b* might be employed. It is not necessary that the bracket have any significant wall area since it does not operate to block wind or hold rubber bands. Further, there is no necessity for a surface of the bracket to align vertically with sheets 20 inasmuch as it is the other finger 51 of each bracket which effectively performs the retaining function rather than a surface 78 which serves only to position a finger 51.

In use, music would be placed in envelopes 20 and lyre 58 clamped to holder 10 as shown in FIGS. 1 and 2. Music may be positioned in envelopes singlely or back-to-back, and then by appropriate arrangement of selections, it is possible for a musician to play in sequence one selection in each of the envelopes and then reverse the position of the holder and play a second selection from each envelope.

Significantly, in order to flip an envelope from one side of plate 11 to the other, one may simply raise the bottom of the top envelope sufficiently to get a finger under it and then raise it, from the bottom upward, which will free this envelope from the fingers of brackets 44 and 46. As previously explained, the envelopes are easily grasped due to diagonally cut corner regions 39. Thus, by a simple movement, opposite sides of the flipped-over envelope may be repositioned and locked in identical brackets on the opposite side of plate 11.

Having thus described my invention, what is claimed is:

1. A music holder of the type employing a transparent envelope supporting member, and wherein the envelope supporting member is adapted to be supported on an upstanding lyre from a musical instrument, said supporting member including means for hingedly connecting rectangular envelopes to an upper edge region of the supporting member, and wherein:

said supporting member comprises a generally flat, rigid plate configured to provide a backing for a substantial area of a said envelope, said plate having a pair of laterally spaced, slotted openings from front to back through said plate, and which openings commence at the bottom of said plate and extend upward, whereby a pair of spaced horizontal members of a lyre supporting said plate may extend horizontally through said openings and thus provide a stabilized holding of said plate by a lyre;

further comprising bracket means comprising a first pair of laterally spaced brackets extending from one surface of said plate and extending outwardly, away from, said plate and then turned laterally toward each other, and a second pair of laterally spaced brackets extending from the opposite surface of said plate and extending outward, away from, said plate and then laterally toward each other;

whereby said brackets are adapted to laterally extend over opposite side regions of envelopes on one face of said plate, and said second pair of brackets are adapted to laterally extend over opposite side regions of envelopes on the opposite face of said plate and thereby lock said envelopes from being blown from one side to the other and thus out of said holder.

2. A music holder as set forth in claim 1 wherein said bracket means comprises a pair of U-shaped brackets attached to opposite side edges of said plate, said U-shaped brackets being oriented and in facing relationship, forming on either side of said plate turned-in brackets which secure said envelopes.

3. A music holder as set forth in claim 2 wherein at least one lower corner edge region of said plate is removed, removal being generally along a line from one of said brackets diagonally downward and inward, whereby a said envelope may be more readily engaged and lifted out of said brackets.

4. A music holder as set forth in claim 3 wherein said envelope is formed having an opening along a top edge of said envelope adjacent to its attachement to said plate, and other edges of said envelope being closed, whereby a sheet of music may be inserted through said opening and be secured by closed sides and bottom of said envelope.

* * * * *